United States Patent [19]

Foote

[11] 4,047,406

[45] Sept. 13, 1977

[54] ANTI-RAP MOUNTING FOR PERMUTATION LOCK ELEMENTS

[75] Inventor: Daniel J. Foote, Wauwatosa, Wis.

[73] Assignee: Master Lock Company, Milwaukee, Wis.

[21] Appl. No.: 720,191

[22] Filed: Sept. 3, 1976

[51] Int. Cl.[2] ..... E05B 37/04

[52] U.S. Cl. ..... 70/25; 70/416

[58] Field of Search ..... 70/25, 24, 38 A, 21, 70/22, 23, 312, 416, 418

[56] References Cited

U.S. PATENT DOCUMENTS

| | | | |
|---|---|---|---|
| 2,163,852 | 6/1939 | Pond | 70/25 X |
| 3,419,893 | 12/1968 | Vahlstrom | 70/24 |
| 3,766,758 | 10/1973 | Heine | 70/25 |
| 3,983,724 | 10/1976 | Foote | 70/25 |

*Primary Examiner*—Robert L. Wolfe

*Attorney, Agent, or Firm*—Curtis B. Morsell, Sr.

[57] ABSTRACT

In a popular form of changeable combination padlock there is a pivotally mounted, spring urged blocking lever whose lower end portion is pivotally associated with the clutch elements for the dialing wheels and whose upper end portion engages a pair of shackle locking bolts when the shackle is retracted and locked holding the locking bolts in a so-called "dead-bolt" condition. The last mentioned portion of the blocking lever is free to move, however, within a cavity in the lock case and bolt housing to disengage and release said locking bolts when the permutation mechanism is correctly operated for shackle unlocking purposes. In a changeable combination padlock of the type under consideration the cavity within the case wherein the upper portion of the blocking lever can move, is relatively commodious. In practice it has been found that a thief or tamperer, by pressing down on a portion of the shackle and rapping on a face of the padlock case with a tool or the like, can unauthorizedly impart vibrations to said blocking lever of such magnitude, permitted by the commodious cavity which accommodates said blocking lever portion as to permit disengagement of said blocking lever portion from the shackle locking bolts whereby the lock may be unauthorizedly unlocked with the dialing mechanism being bypassed. To overcome this disadvantage the present invention so mounts the described movable portion of the blocking lever within such a restricted cavity that rapping or like tampering actions by a thief or the like will be completely ineffectual to cause such vibratory movements of the blocking lever portion as would be sufficient to free it from the shackle locking bolts.

1 Claim, 3 Drawing Figures

ANTI-RAP MOUNTING FOR PERMUTATION LOCK ELEMENTS

BACKGROUND OF THE INVENTION AND SUMMARY THEREOF

A general object of the invention is to provide a combination padlock wherein the case and bolt housing cavity in which the upper portion of the blocking lever is free to move during normal correct operating conditions is of such limited or restricted length that it permits movement of the blocking lever only sufficient to disengage it from the locking bolts; there being insufficient space for such vibratory movements of the blocking lever set up by unauthorized rapping as to free it from the locking bolts.

A more specific object of the present invention is to provide, in a combination padlock of the character described having a cavity in the bolt housing of the case which accommodates the movable blocking lever, a bridge or wall in the bolt housing of the case which materially restricts the length of said cavity so that the blocking lever may "back out" in said cavity a distance only sufficient to disengage it from the bolts, but no further; such path of movement being only infinitesimally greater than the breadth of said portion of the blocking lever.

Further objects of the invention are to provide a changeable combination padlock with an anti-rap mounting for certain of its elements which is relatively simple to manufacture and assemble, in which the anti-rap feature functions automatically, which is strong and durable, which is neat and attractive in appearance, and which is effective for its intended purposes.

DESCRIPTION OF THE PRIOR ART

All of the prior patents relating to changeable combination padlocks known to applicant have blocking lever cavities which are not restricted at their front ends by walls or bridges and are of such length that "rapping" operations can cause unauthorized backing out of the blocking lever portions distances equal to the breadths, of the levers plus the thickness of the bolt housings which are unwalled in the front extents of the cavity areas.

BRIEF DESCRIPTION OF THE DRAWING

In the accompanying drawing wherein the same reference characters indicate the same parts in all of the views.

DESCRIPTION OF THE PREFERRED EMBODIMENT

Figure 1:
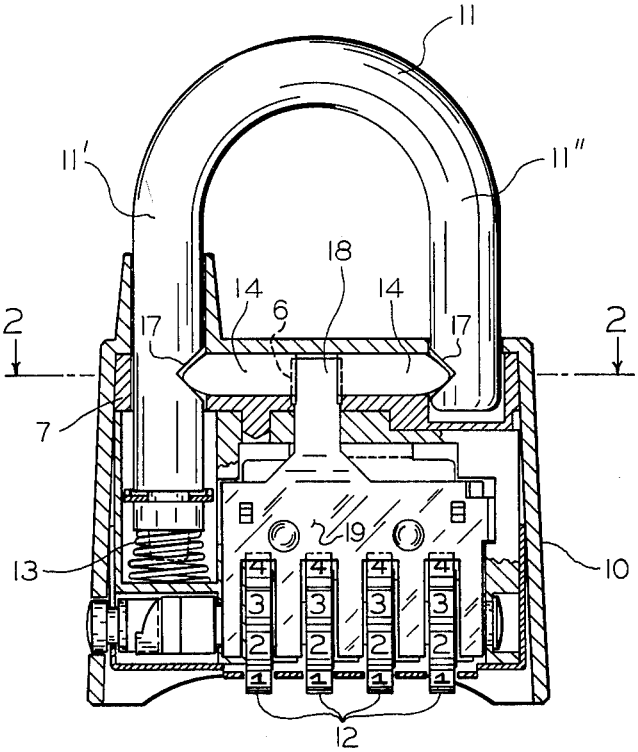
FIG. 1 is a front elevational view of a combination padlock incorporating the rap-proof mounting arrangement for the blocking lever, the padlock case and its inner bolt housing being shown in vertical section.

A typical changeable combination padlock with which the present "anti-rap" improvement is associated is shown in FIG. 1 of the drawing. The illustrated combination padlock is the same as that illustrated and described in applicant's co-pending application Ser. No. 597,961, filed July 21, 1975 and officially allowed May 3, 1976 and now U.S. Pat No. 3,983,724, except that it has been modified to incorporate the anti-rap mounting for the blocking finger portion 18 of the pivotal blocking lever 19. For the purposes of this application it will only be necessary to describe those portions of the combination padlock above referred to which are directly responsible for the anti-rap features.

The padlock, of course, includes the usual body or case 10 within a portion of which there is a closely fitting bolt housing 7. The case has projecting from its upper end a shackle 11 with a long leg 11' and a short leg 11''. The shackle, when the padlock is unlocked by proper actuation of the permutation wheels 12, is projected from the closed position of FIG. 1 to an open position by a coiled spring 13 confined within the case 10 adjacent the lower end portion of the long leg 11' of the shackle.

In order to releasably lock the shackle in its closed position, a pair of oppositely disposed locking bolts 14 are provided which are operatively housed within a suitable opening therefor in an upper portion of the bolt housing 7. These bolts are biased in opposite directions by a pin mounted spring 15. In the locked condition of the shackle legs, as in FIG. 1, the outer end portions of the same enter alined notches 17 in the shackle legs 11' and 11'' which notches have angled walls.

The shackle locking bolts 14 are controlled by the blocking finger portion 18 of the previously mentioned pivotal blocking lever 19 which is mounted and which functions all as is described in said previously identified application.

Figure 2:
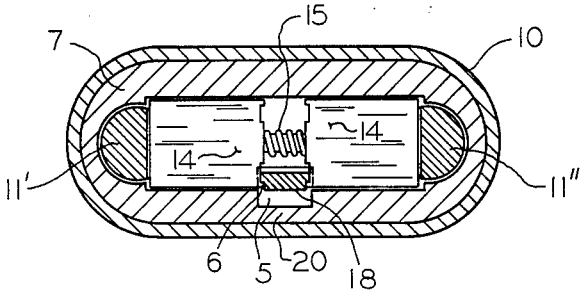
FIG. 2 is a transverse horizontal sectional view taken on line 2—2 of FIG. 1 and showing the blocking lever portion in its engaged position with the locking bolts.
Figure 3:
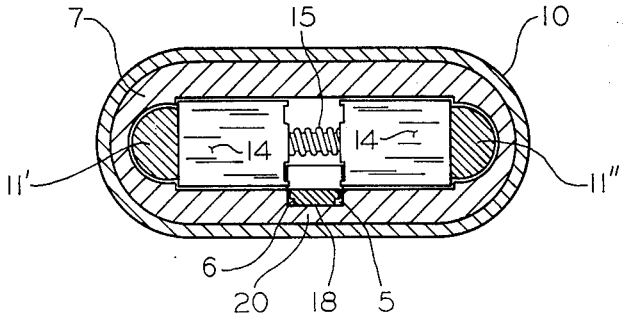
FIG. 3 is a similar transverse horizontal sectional view only with the portion of the blocking lever moved forwardly in its cavity and in contact with the bridged portion of the bolt housing which restricts the lever movement, the position of the blocking lever portion being such that the locking bolts may disengage the shackle legs.

In the structure of said previously identified application, and other patents in the prior art there is a cavity within the bolt housing which extends from between the inner end portions of the locking bolts transversely toward a face wall of the lock case 10. In said prior art, in alinement with the front end of said cavity, the bolt housing wall is cut away or formed with an opening which very materially elongates the blocking lever opening and allows the blocking lever to oscillate forwardly a substantial distance. In the instant improvements the blocking lever cavity is indicated by the numeral 6 and the objectionable alined full opening in the bolt housing 7 is restricted to a recess 5 of slight depth and whose forward end is closed by a bridge or wall 20 (see FIGS. 2 and 3) which is of great importance in limiting the length of the oscillatory movements of the portion 18 of the blocking lever 19 to thereby overcome the objectional results of rapping, inherent in the prior art.

If the shackle 11 is in its released raised position, it can be manually depressed to its closed locked condition shown in FIG. 1 in the standard manner. The outer end portions of the locking bolts 14 lodge within the angled recesses 17 therefor in the shackle legs 11' and 11''. The pivotal blocking lever 19 has moved to a position wherein its reduced blocking finger portion 18 assumed the position of FIG. 2 holding the locking bolts in a so-called dead-bolt condition. During normal correct dialing operations the blocking finger portion 18 is free to back out in its cavity 5 from the position of FIG. 2 to the position of FIG. 3. The extent of forward movement of the blocking finger is limited by the bridge or wall 20 in the bolt housing 7 which materially limits the length of said cavity 5 and the consequent backing out movement of the blocking finger. Actually the path of movement for the blocking finger is only sufficient to permit its disengagement from the locking bolts, but no further, and the length of the path of travel is only infinitesimally greater than the breadth of said portion of the blocking finger.

In the prior art combination padlocks previously referred to because of the undue length of the cavities in which the blocking fingers moved, a tamperer or thief could effect release of the shackle legs and unauthorized opening of a padlock by certain rapping or hammering operations on a face portion of a padlock he sought to open by bypassing the dialing mechanism. Such rapping action performed on a padlock of the prior art type while an exposed portion of the shackle was being pressed down, could be effective to cause vibrations or oscillations of the blocking finger of such magnitude as to permit disengagement of the blocking finger from the inner ends of the locking bolts. This undesirable and unnecessary magnitude of movement of the blocking finger resulted from the extra length of the blocking finger cavity because, in the prior art the bolt housing, at the forward end of the cavity was completely open and forward movement of the blocking finger was not checked until it met the adjacent portion of the lock case wall. The simple, but highly effective expedient incorporated in the instant improvements of materially limiting the commodiousness of the blocking finger cavity, very effectively thwarts the previously described method of tamperers to bypass the permutation mechanism of the padlock by unauthorized rapping procedures.

In the improved permutation padlock the anti-rap mounting for certain of the elements in no way affects the general structure of the padlock and its various authorized operational features including the means for changing the lock combination, all as is described in the previously identified application.

From the above description it will be evident that the improved anti-rap mounting for permutation lock elements is both simple and effective and is generally well adapted for the intended purposes.

What is claimed is:

1. In a permutation lock, a body, a bolt housing lining a portion of said body, a shackle movable in the body including the lined portion of the latter and having a closed position and a projected open position, a pair of separate locking bolts mounted within a cavity in the lined portion of the body in a manner as to slide in opposite directions into locking engagement with the legs of the shackle when the latter is in its closed position, resilient means normally urging said locking bolts in opposite directions into releasable locking engagement with the shackle legs, a blocking lever separate from the locking bolts pivotally mounted within the body and having a reduced blocking finger at one end movable in a path at right angles to the axis of the locking bolts into locking position between the inner ends of said locking bolts to prevent undesired retraction thereof out of locking position relative to the shackle legs, said blocking finger being accommodated by a cavity within the lined portion of the lock body whose forward end portion communicates with an alined recess therefor only in the inner face portion of the bolt housing, the forward end portion of the last-mentioned cavity being closed by a rigid bridge in said portion of the bolt housing so that the last-mentioned cavity can snugly receive the blocking finger and positively limit its path of travel within the last-mentioned cavity and relative to the spaced inner ends of the locking bolts a distance only infinitesimally greater than the breadth of said blocking finger so that unauthorized raps imposed on a portion of the lock body cannot cause surreptitious oscillations of said blocking finger sufficient to free it from the locking bolts.

* * * * *